US006124538A

United States Patent [19]

Landell

[11] Patent Number: 6,124,538

[45] **Date of Patent: *Sep. 26, 2000**

[54] MUSICAL INSTRUMENT

[76] Inventor: Jonathon A. Landell, Rd. 2, Box 277B, Williams Hill Rd., Richmond, Vt. 05477

[ * ] Notice: This patent issued on a continued prosecution application filed under 37 CFR 1.53(d), and is subject to the twenty year patent term provisions of 35 U.S.C. 154(a)(2).

[21] Appl. No.: 08/667,669

[22] Filed: Jun. 21, 1996

[51] Int. Cl.[7] ..... G10D 7/02

[52] U.S. Cl. ..... 84/384

[58] Field of Search ..... 84/384, 452 R, 84/383 A

[56] References Cited

U.S. PATENT DOCUMENTS

| | | | |
|---|---|---|---|
| 1,376,004 | 4/1921 | Christensen | 84/384 |
| 1,455,440 | 5/1923 | Hofinger | 29/896.22 |
| 1,727,868 | 10/1929 | Dreves . | |
| 3,616,279 | 10/1971 | Kendall | 204/14 N |
| 3,619,385 | 11/1971 | Rjumshina | 204/35 N |
| 3,630,792 | 12/1971 | Samyth | 148/6.3 |
| 4,108,736 | 8/1978 | Rigo | 204/1.5 |
| 4,308,784 | 1/1982 | Eizonas | 84/452 R |
| 4,516,463 | 5/1985 | Satoh | 84/385 R |
| 4,713,150 | 12/1987 | Hornbostel | 204/38.3 |
| 4,875,401 | 10/1989 | Culbreath | 84/384 |
| 4,962,007 | 10/1990 | Phelan | 428/670 |
| 4,971,759 | 11/1990 | Watanabe et al. | 420/502 |
| 4,998,456 | 3/1991 | Matti | 84/384 |
| 5,160,599 | 11/1992 | Kobayashi | 205/106 |
| 5,215,606 | 6/1993 | Tsukamoto | 148/518 |
| 5,227,572 | 7/1993 | Cusack et al. | 84/383 A |
| 5,275,703 | 1/1994 | Shih | 204/140 |
| 5,288,372 | 2/1994 | Baker | 204/129.1 |

*Primary Examiner*—William M. Shoop, Jr.
*Assistant Examiner*—Shih-yung Hsieh
*Attorney, Agent, or Firm*—Michael W. Starkweather

[57] ABSTRACT

A musical instrument made in whole or in part of titanium and its alloys. Titanium instruments tend to be lighter than other instruments made of other materials like silver and/or gold. Additionally, titanium proves to be more durable and resistant to marring than other materials used in making instruments. An inherent property of titanium provides the ability to create an infinite number of color hues and patterns of colors on the instrument by the use of known titanium anodization processes. Additionally, it is possible to remove the existing colors created by an anodization process, and to further cause the instrument to be changed into other colors or patterns of colors.

19 Claims, 1 Drawing Sheet

MUSICAL INSTRUMENT

BACKGROUND OF THE INVENTION

1. Field of the Invention

The invention generally relates to a musical instrument made of titanium and its alloys. In particular, the specific preferred embodiment involves flutes made of titanium and its alloys.

2. Description of the Related Art

Making a high quality musical instrument requires accommodating several objectives that are not always compatible. A quality instrument should: produce high quality sounds, be light weight, be attractive in appearance, and be physically durable.

The flute, for example, is one of the world's oldest musical instruments, and it is also one of the simplest. A flutist produces a musical note by creating a vibrating column of air inside the instrument.

Regarding the objective of producing a high quality sound, the tone quality of a flute depends largely on the skill of its maker, it also depends to a significant extent on the materials used to assemble it. The tone quality of a flute is improved by making the tubing from a dense and hard metal. Precious metals, in their commonly-used alloys, such as silver or gold, are dense and can be hardened to produce quality flute tones. Many professional musicians believe that flutes with silver alloy tubing produce a brighter tone, gold alloy flutes produce warmer and richer tones, and platinum flutes produce a harder tone.

Regarding the objective of appearance, gold colored flutes offer the particular advantage of its unique color, which stands out from the more common steel or silver colored flutes. However, the cost of a gold flute is dramatically higher than the other available materials.

Regarding the objective of light weight, gold is definitely heavier than the other materials typically used in constructing flutes. Although, the relatively small size of flutes usually does not typically produce too heavy an instrument, unlike a tuba, for example, it can be difficult to play a flute for long periods of time, especially when playing the larger base flute for example.

Regarding the objective of durability, both gold and silver are characteristically softer metals than the other materials used to make flutes. Although, it is easier to keep the instrument safer because of the small size of flutes, unlike the tuba or trombone, it is still subject to unwanted damage from banging or dropping it.

Based upon the objectives for a high quality instrument, gold flutes are often the most desirable flute among professionals. The incentive for owning a gold flute is its sound quality and its distinctive color. The disadvantage of a gold flute is that it is: expensive, heavier, and softer.

In light of the above desirability for gold flutes, there is a need for a flute, or any instrument for that fact, that is less expensive, is equally as attractive, is more durable, and is lighter in weight than gold.

The subject preferred embodiment of the invention solves the identified problems for most all instruments. In particular, a flute that is made of titanium or its alloys exceeds all of the above identified objectives for a high quality instrument. Specifically, the cost of titanium is currently three to five times less expensive than even silver. The sound of a titanium flute produces a rich vibrant quality and is as responsive. A titanium flute is much lighter than both silver and gold; this will be a big advantage when considering larger instruments like a tuba. A titanium flute is also much more durable and resistant to marring; a titanium alloyed flute could be dropped without creating noticeable dents. A notable advantage of a titanium flute is the ability to easily produce an infinite number of color hues and patterns by the use of known anodization processes.

RELATED PATENTS

Examples of patents that are related to the present embodiment are as follows, wherein each of the following patents are herein incorporated by reference for the supporting teachings:

U.S. Pat. No. 5,215,606, is a method for preparing decorative lacquered Ti-based articles is disclosed, which method comprises the steps of: a) heating in a vacuum a titanium body to create an uneven surface, b) cooling the material, c) etching the surface to enlarge the unevenness of the surface, d) anodizing the material, e) applying an undercoat to the surface, f) optionally curing the undercoat, g) further applying another coat, and h) drying the material. The method makes it possible to prepare decorative lacquered Ti-based articles having a raden, hyomon or heidatsu, kyushitsu or makie-like appearance.

U.S. Pat. No. 5,160,599, is a process for coloring titanium, or its alloys that comprises the steps of anodizing titanium metal in an electrolytic solution until the voltage reaches a predetermined voltage at a constant current temporarily cutting off the current supply to interrupt the anodizing; and then supplying a direct current again at a predetermined current density to continue anodizing, wherein the color tone of the anodic oxide film formed on the titanium is adjusted by controlling the supplied amount of current, without causing an increase in voltage. By the coloring process of the present invention, the color of titanium metal can be changed to various color tones at low voltages.

U.S. Pat. No. 4,998,456, is a body structure of a wind instrument and a procedure for making a wind instrument body presenting the structure. The body of a wind instrument, such as a flute, consists of an elongated tube composed of one or several parts (1) in said tube apertures (2) openable and closable with separate keys as required by playing, are made. As taught by the invention, the tube or its parts are made of plastic material, with which one or several fiber courses are combined for reinforcement. An appropriate plastic material is epoxy plastic, and appropriate fibers are carbon fibers. With these is obtained a body construction which has a high rigidity and low mass and which produces sound with minimal blowing energy.

U.S. Pat. No. 4,971,759, is a composition of a silver alloy type material used for production of flutes, a specified amount of at least one of Ni, Fe, Co and Cr or at least one of Mn, Ti, Zi and Si is added to suppress softening and crystal grain size coarsening caused by annealing in production. Thus, flutes which generate brilliant sounds in mid to high notes can be obtained.

U.S. Pat. No. 4,962,007, is a musical instrument having tubing made of a mechanically unitary laminated metal tube that has at least one layer of precious metal alloy bonded to another layer of metal alloy.

U.S. Pat. No. 4,713,150, is an article of manufacture having a metallic surface consisting of brass or stainless steel is overcoated with a first layer of nickel and a second layer of elemental niobium, The article may thereafter be color anodized in a solution of ammonium sulfate without the need for a hydrofluoric acid etch to produce a highly attractive and colorful ornamental surface finish. After anodization, the articles may be coated with clear epoxy or a sputter deposited transparent ceramic coating for added wear resistance.

U.S. Pat. No. 4,108,736, is a method for forming surface coatings on a substrate by anodic oxidation, wherein the substrate contains, at least in those of its parts which are immediately sub-adjacent to its surface, at least one element selected from niobium, chromium, molybdenum, tungsten, titanium and vanadium, or a conducting compound containing such a first element, and at least one second element, different from the first, selected notably from silicon, aluminum, gallium, tantalum, uranium and molybdenum, either in the metallic state, if it constitutes itself a semiconductor element, or even an insulator, or in the combined or alloyed state with at least one other element to form a semi-conductor compound, or even an insulator, said second element being flush at least in part at the surface of the substrate. The invention also relates to the coating themselves and which comprise a superficial layer and an inner layer of an oxide of the first element separated by an intermediate layer containing an oxide of the second element.

U.S. Pat. No. 3,630,792, is a process for the production of colored surfaces on zinc, tin and lead-tin coatings by the provision of oxide films having light interference effects; zinc, tin and lead-tin alloys for use in the process; and alloy coating compositions and colored articles produced thereby. A molten alloy of zinc, tin or lead-tin with a minor amount of an oxygen-avid element such as titanium, manganese or vanadium is oxidized by exposure to a free oxygen containing gas under controlled time and temperature conditions for the provision of a surface film of an oxide of the oxygen-avid addition element having light interference color characteristics.

U.S. Pat. No. 3,619,385, is a polychrome image that is produced on the surface of an article by depositing on a solid dielectric layer a thin film of a unilaterally conducting metal or alloy thereof to a thickness of at least 500 angstroms followed by breaking the film into separate areas in conformity with the shape of the picture to be reproduced, the areas being electrically insulated from one another. Thereafter the areas are subjected to selective anodic oxidation at a constant current density of less than 10 ma./(cm*cm) and at working voltages which vary from one area to another in a range of 5 to 250 volts.

U.S. Pat. No. 3,616,279, is an electrolyte method and composition for coloring titanium and its alloys. The colors imparted are controlled by voltage input to the electrolyte so that a wide selection of colors, each corresponding to a specific voltage level, may be obtained and reproduced from one surface to another by use of the same selected voltage levels. The electrolyte is a two-part composition consisting of an organic and an inorganic constituent. The organic constituent is one of a group of amides of which dimethylformamide is preferred. The inorganic constituent is a fluoride-bearing compound of which fluoboric acid is preferred.

These incorporated by reference patents reflect the state of the art of which the applicant is aware and are tendered with a view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE PREFERRED EMBODIMENT

It is a feature of the invention to provide a musical instrument made in whole or in part of titanium and its alloys. In particular, the specific preferred embodiment involves flutes made of titanium and/or its alloys.

A further feature of the invention is to provide an instrument, in particular a flute, that uses less expensive materials than silver or gold.

An additional feature of the invention is to provide an instrument, in particular a flute, that produces a rich vibrant quality and is as responsive as other instruments of other materials.

Yet a further feature of the invention is to provide an instrument, in particular a flute, that is much lighter than both silver and gold material instruments.

An aspect of the invention is to provide an instrument, in particular a flute, that is durable and resistant to marring.

Another aspect of the invention is to provide an instrument, in particular a flute, that has the ability to be an infinite number of color hues and patterns of colors by the use of known anodization processes.

Still another aspect of the invention is to provide an instrument, in particular a flute, that is capable of removing the existing colors created by an anodization process, and to further cause the instrument to be changed into other colors or patterns of colors.

The invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, neither is it intended to be limiting as to the scope of the invention in any way.

Other features of the present invention will become more clear from the following detailed description of the invention, taken in conjunction with the accompanying drawings and claims, or may be learned by the practice of the invention.

Figure 1:
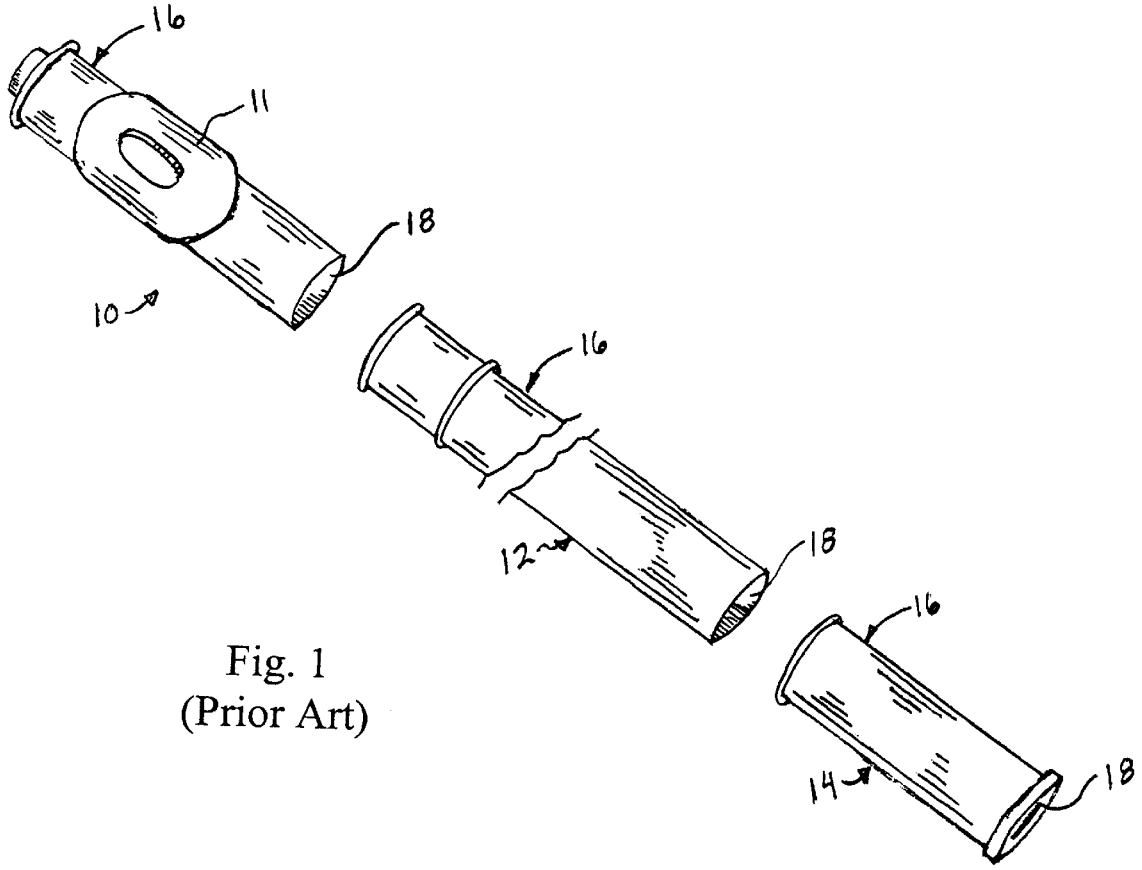
Fig. 1 (Prior Art)
FIG. 1 is a simplified perspective view of a typical flute.

It is noted that the drawings of the invention are not to scale. The drawings are merely schematic representations, not intended to portray specific parameters of the invention. The drawings are intended to depict only typical embodiments of the invention, and therefore should not be considered as limiting the scope of the invention. The invention will be described with additional specificity and detail through the use of the accompanying drawings.

Charter by the U.S. Constitution

This disclosure of the invention is submitted in furtherance of the constitutional purposes of the United States Patent Laws "to promote the progress of science and useful arts," as stated in Article 1, section 8, paragraph 8 of the United States Constitution.

DETAILED DESCRIPTION OF THE PREFERRED EMBODIMENT

Referring to FIG. 1, there is a simplified perspective exploded view of a typical flute made according to the invention. The flute includes a head joint 10, a center joint 12, and a foot joint 14, which may be assembled to form a complete flute for playing. The headjoint 10 is shown with an embouchure plate 11 with its breath hole, which are added to the headjoint tubing during manufacture of the headjoint. As is well known in the art of making flute headjoints, a high quality flute headjoint is usually slightly tapered and has a diameter which generally tends to decrease with increasing distance along the longitudinal axis of the headjoint from the point of attachment to the middle joint. This tapering is not shown in FIG. 1. The center joint 12 and the footjoint 14 are shown without keys or tone holes, which are also added during manufacture of the flute. The centerjoint 12 and the footjoint 14 are usually substantially cylindrical. Each of the headjoint 10, the centerjoint 12, and footjoint 14 has an outer surface 16 and an inner surface 18.

The colors produced on the surface of titanium and its alloys are those present in the spectrum produced from white light, and the colors produced at successively increased voltage levels appear in the same order of colors as they are found in the spectrum. Thus, when the voltage is increased in increments above a level of about 10 volts an order of colors are possible to design, wherein the order is approximately as follows: indigo, dark blue, light blue, green, yellow, and salmon. These colors are only illustrative of possible ranges but are not restrictive since various other colors and shades including iridescent properties are also possible.

Coloration by an anodic oxidation process as is not limited to pure titanium. Such a coloring process is also applicable to titanium alloys of Ti-6Al4V, Ti-8Al-1V or in addition alpha, alpha-beta, or beta alloys. So long as alloys contain titanium as a principal element and other additive elements are dissolved in a solid solution state in titanium, color adjustment can be achieved without any undesirable effect. Further, the coloring process is also effectively applicable to alloys with metal (e.g., Al, Zr, and vinadium etc.) which can be anodized similarly to titanium and, also in such alloys titanium should be contained as a principal alloying element.

The color imparted to the surface of titanium and its alloys in an anodization process may be effectively removed either by immersion in a non-aqueous bath suitable for the purpose or by manual application of the bath to the colored surface to be changed. A bath that is well suited for this purpose consists of 70 percent acetic acid, 20 percent sulfuric acid, and 10 percent hydrofluoric acid. This path whether used for immersion or manual application is effectively operated at ambient temperature of the order of 60–90 degrees F for about 1 to 2 minutes. See U.S. Pat. No. 3,468,774 which is herein incorporated by reference.

REMARKS ABOUT THE PREFERRED EMBODIMENT

Given the inherent characteristics of titanium, one skilled in the art of metal making and more particularly with instrument making, it should be readily apparent that there are many marketable advantages to a titanium instrument. For example, it is possible to have the metal colorized before or after the instrument has been assembled. Additionally, it is also possible to change the color of the instrument after it has been sold to a user. Specifically, by immersing a returned instrument in the requisite solutions and applying the appropriate voltages colorization is possible. Moreover, with the known anodizing techniques, it is possible to create patterns of colors and/or rainbow effects. For example, by preventing anodation of certain spots on the surface non-colored or alternative-colored areas are produced. Additionally, by applying differing voltages to different locations on an instrument it is also possible to create patterns of different colors on the instrument.

A skilled artisan in instrument design and construction may easily realize that the use of titanium will greatly decrease the chances of potential damage to the typically delicate instrument because of the inherent high structural durability and strength of titanium. Particularly, brass, which is a major material typically used in making instruments, is dented or scratched much easier than titanium. For example, it would be possible to drop a flute onto a concrete surface with little or no appreciably noticeable marring resulting. This benefit is even more pronounced in using titanium in larger instruments, like a tuba or french horn.

It is noted that using materials with over 85% of titanium will greatly increase the ease of anodization for coloration. In particular, 90% by weight of titanium mixed with 4% of vinadium and 6% of aluminum is a good material. Moreover, commercially pure titanium, having 99% by weight of titanium is beneficial. However, any percent by weight of titanium that provides the benefits discussed herein is anticipated to be used.

Obvious Variations in the Preferred Embodiment

The preferred embodiment of the invention discusses the use of colorizing the whole instrument. However, one skilled in the art would easily understand how to apply the invention to only selected portions of instruments, like the tube of a flute but not the air hole and key portions.

Although this embodiment typically discusses the use of a flute, it is apparent to one skilled in the art that most any instrument that has metallic parts can benefit from the invention. For example, the frets of a guitar, a trumpet, a drum body, and a harp are all possible instruments to be made of titanium parts. An additional variation of the invention contemplates the use of applying most any known anodizing process to create color in a titanium based material, and should not be limited to the particular processes discussed in this disclosure.

The preferred embodiment typically discusses the use of titanium as a solid piece of material, where in fact it is anticipated to use only a layer of titanium or the like. For example, a top layer or surface 16 could be made of titanium and an inner layer or surface 18 may be made of gold. Thus having the benefit of both materials. Closely related to layering titanium is to mix other materials on portions of the surface to create patterns of metals.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Patent is:

1. A process for making a musical flute for making sounds, comprising the steps of:

a) providing an elongated tube, for receiving and directing sound vibrations, including of first piece that is substantially inflexible and is composed of a material that is at least a majority of an amount by composition of titanium, and a remainder of composition consisting of other materials;

b) providing a sound means, attachable to the tube, for creating the sound vibrations by blowing air thereon;

c) providing a varying means, located on the tube, for varying the sound vibrations created by the sound means and for creating different tones thereby; and d) wherein the material is proportioned for enabling repeated color change thereof upon being repeatably exposed to a process that can repeatably and controllably produce selectable color in the appearance of the first piece.

2. The process of claim 1, further comprising the step of:

subjecting the first piece to a coloring process that will cause at least one color to be produced on the first piece that is not an original color of the first piece.

3. The process of claim 2, wherein the coloring process is repeated two times to achieve first one and then another different color on the first piece.

4. The process of claim 2, wherein the coloring process is performed on a second location on the first piece to acheive a second color, that is not an original color of the first piece, simultaineous to the first color on the first piece.

5. The process of claim 1, wherein the sound means is a hole in a mouth piece.

6. The process of claim 5, wherein the varying means are holes and keys located on the elongated tube.

7. The process of claim 1, wherein the selectable color has a blue hue.

8. A process of making a musical instrument, comprising the steps of:

a) providing a sound producing means for creating air vibrations;

b) providing a body for receiving the air vibrations therein having a first piece;

c) composing the first piece out of a material that has a majority of an amount by composition of titanium, and a remainder of composition consisting of other materials; and d) wherein the material is proportioned for enabling repeated color change thereof upon being repeatably exposed to a process that can repeatably and controllably produce selectable color in the appearance of the first piece.

9. The process of claim 8, wherein the material is proportioned for enabling repeated color change thereof upon being repeatably exposed to a process that can repeatably and controllably produce selectable color in the appearance of the first piece.

10. The process of claim 8, further comprising the step of:

subjecting the first piece to a coloring process that will cause at least a first color to be produced on the first piece that is not an original color of the first piece.

11. The process of claim 10, wherein the first piece is subjected to the coloring process a second time to cause at least a second color to be produced on the first piece that is not an original color or a first color found on the first piece prior to this step.

12. The process of claim 8, further comprising the step of:

subjecting a first and second part of the first piece to a coloring process to cause at least a first color on the first part and a second color on the second part to be produced on the first piece that are not an original color and are not a same color.

13. The process of claim 12, wherein the first color is a hue of purple.

14. The process of claim 12, wherein the musical instrument is a flute.

15. The process of claim 14, wherein the musical instrument is a guitar body.

16. A process of making a musical instrument, comprising the steps of:

a) providing a body for the musical instrument for creating and receiving air vibrations;

b) composing, at least a portion of the body, out of a material that has a majority of an amount by composition of titanium, and a remainder of composition consisting of other materials, wherein the material is proportioned for enabling repeated color change thereof upon being repeatably exposed to a process that can repeatably and controllably produce selectable color in the appearance of the at least a portion of the body.

17. The process of claim 16, wherein the body of the musical instrument comprises:

a) a sound producing means for creating air vibrations;

b) a sound receiving means for receiving the air vibrations therein; and c) a varying means, located on the sound receiving means, for varying the sound vibrations created by the sound producing means and for creating different tones thereby.

18. The process of claim 17, further comprising the step of:

subjecting the at least the portion of the body to a coloring process that will cause at least one color to be produced on the first piece that is not an original color of the first piece.

19. The process of claim 18, wherein the at least one color has a blue hue.

* * * * *